US011196136B2

(12) United States Patent
Tian et al.

(10) Patent No.: US 11,196,136 B2
(45) Date of Patent: Dec. 7, 2021

(54) CAVITY FILTER

(71) Applicant: HUAWEI TECHNOLOGIES CO., LTD., Guangdong (CN)

(72) Inventors: Wei Tian, Xi'an (CN); Yong Wu, Xi'an (CN); Qing Zhao, Xi'an (CN); Hui Wang, Xi'an (CN)

(73) Assignee: HUAWEI TECHNOLOGIES CO., LTD., Guangdong (CN)

( * ) Notice: Subject to any disclaimer, the term of this patent is extended or adjusted under 35 U.S.C. 154(b) by 0 days.

(21) Appl. No.: 16/897,834

(22) Filed: Jun. 10, 2020

(65) Prior Publication Data

US 2020/0303797 A1 Sep. 24, 2020

Related U.S. Application Data

(63) Continuation of application No. PCT/CN2017/120213, filed on Dec. 29, 2017.

(51) Int. Cl.

| | |
|---|---|
| ***H01P 1/207*** | (2006.01) |
| ***H01P 1/04*** | (2006.01) |
| ***H01P 1/205*** | (2006.01) |
| ***H01P 7/06*** | (2006.01) |
| ***H01P 11/00*** | (2006.01) |

(52) U.S. Cl.

CPC ..... *H01P 1/207* (2013.01); *H01P 1/042* (2013.01); *H01P 1/045* (2013.01); *H01P 1/205* (2013.01); *H01P 7/06* (2013.01); *H01P 11/007* (2013.01)

(58) Field of Classification Search

CPC ..... H01P 1/207; H01P 1/042; H01P 1/045; H01P 1/205; H01P 7/06; H01P 11/007

See application file for complete search history.

(56) References Cited

U.S. PATENT DOCUMENTS

| | | | |
|---|---|---|---|
| 9,083,071 | B2 | 7/2015 | Kaneda et al. |
| 2004/0041661 | A1 | 3/2004 | Yamakawa et al. |

(Continued)

FOREIGN PATENT DOCUMENTS

| | | | |
|---|---|---|---|
| CN | 101276952 | A | 10/2008 |
| CN | 201138682 | Y | 10/2008 |
| CN | 101378142 | A | 3/2009 |

(Continued)

OTHER PUBLICATIONS

International Search Reported dated Sep. 27, 2018, issued in counterpart Application No. PCT/CN2017/120213, with English Translation. (10 pages).

(Continued)

*Primary Examiner* — Robert J Pascal
*Assistant Examiner* — Kimberly E Glenn
(74) *Attorney, Agent, or Firm* — Westerman, Hattori, Daniels & Adrian, LLP

(57) ABSTRACT

A cavity filter includes a cavity, a cover plate, a tuning component, and a resonant column. The cover plate is connected to the cavity, and the cover plate is configured to cover the cavity to form a resonant cavity. A through hole is provided on the cover plate, and the tuning component passes through the through hole and is fastened on the cover plate. The tuning part includes a high-conductivity part and a non-conductivity part, the high-conductivity part is located in the cavity, and the resonant column is in the cavity.

15 Claims, 5 Drawing Sheets

(56) References Cited

U.S. PATENT DOCUMENTS

| | | | | |
|---|---|---|---|---|
| 2005/0219013 | A1* | 10/2005 | Kumar | H01P 1/2053 333/203 |
| 2015/0288043 | A1* | 10/2015 | Buchauer | H01P 1/2053 333/207 |

FOREIGN PATENT DOCUMENTS

| | | | |
|---|---|---|---|
| CN | 102569978 | A | 7/2012 |
| CN | 102626005 | A | 8/2012 |
| CN | 102804484 | A | 11/2012 |
| CN | 103682536 | A | 3/2014 |
| CN | 104518264 | A | 4/2015 |
| CN | 204706618 | U | 10/2015 |
| CN | 105280998 | A | 1/2016 |
| CN | 105304987 | A | 2/2016 |
| CN | 105304988 | A | 2/2016 |
| CN | 105552495 | A | 5/2016 |
| CN | 205355216 | U | 6/2016 |
| CN | 205452496 | U | 8/2016 |
| CN | 206595371 | U | 10/2017 |
| EP | 2533356 | A1 | 12/2012 |
| JP | H05335819 | A | 12/1993 |
| KR | 20040061458 | A | 7/2004 |
| KR | 20090080761 | A | 7/2009 |
| KR | 20140004340 | U | 7/2014 |
| WO | 2010133049 | A1 | 11/2010 |
| WO | 2016095165 | A1 | 6/2016 |
| WO | 2016106707 | A1 | 7/2016 |
| WO | 2017005731 | A1 | 1/2017 |

OTHER PUBLICATIONS

Office Action dated Oct. 9, 2020, issued in counterpart CN Application No. 201780096409.X, with English Translation. (13 pages).

Extended (Supplementary) European Search Report dated Oct. 22, 2020, issued in counterpart EP Application No. 17935863.5. (9 pages).

* cited by examiner

CAVITY FILTER

CROSS-REFERENCE TO RELATED APPLICATIONS

This application is a continuation of International Application No. PCT/CN2017/120213, filed on Dec. 29, 2017, the disclosure of which is hereby incorporated by reference in its entirety.

TECHNICAL FIELD

This application relates to the field of communications devices, and in particular, to a cavity filter.

BACKGROUND

A cavity filter, as a frequency selection apparatus, is widely applied to the communications field, and in particular, to the field of radio frequency communications. In a communications system, in a device such as a base station or microwave backhaul, a filter is configured to: select a communication signal, and filter out a clutter signal or an interference signal beyond a frequency of the communication signal. The cavity filter usually includes a cover plate and a plurality of cavities. One or more resonant rods are disposed in each cavity, and the resonant rods are fastened on a base in the cavity by using screws. A function of each cavity is equivalent to an electronic oscillation circuit. When the filter is tuned to a proper wavelength of a received signal, the oscillation circuit may be represented as a parallel oscillation circuit including an inductance part and a capacitance part. A resonance frequency of the filter may be adjusted by adjusting the inductance part and the capacitance part. In a conventional filter structure, a tuning screw rod and a resonant rod form a structural capacitor, and the filter is adjusted by adjusting a depth of extending into a resonant cavity by the tuning screw rod.

With increasingly complex communications services and ever-changing application scenarios, communications devices have an increasingly high requirement on a performance indicator of the cavity filter. Therefore, a novel filter needs to be developed and designed to meet a network deployment requirement. The filter of the existing structure generally has a poor tuning capability and poor linearity. In particular, as the tuning screw rod continuously extends into the resonant cavity, a linear slope of the cavity filter increases excessively fast, thereby affecting performance of the cavity filter.

SUMMARY

In view of this, embodiments of this application disclose a novel cavity filter and a tuning component. The cavity filter and the tuning component may effectively suppress outward radiation of a signal, greatly increase a Q value of a single cavity, and optimize linearity. The technical solutions are as follows.

According to a first aspect, this application provides a cavity filtering apparatus. The cavity filtering apparatus may be applied to a microwave outdoor unit system, and may be applied to a transmit channel or a receive channel of a frequency division system. The cavity filter includes a cavity, a cover plate, a tuning component, and a resonant column. The cover plate is connected to the cavity, the cover plate covers the cavity to form a resonant cavity, and an electric field is formed in the resonant cavity. A through hole is usually provided on the cover plate, and the tuning component passes through the through hole and is fastened on the cover plate. The tuning component may be of an axis structure, for example, may be of a rod-shaped structure. The tuning component may be fastened on the cover plate by using a fastening apparatus. It should be noted that the tuning component may move along an electric field direction to implement a tuning function. The tuning component may run through the cover plate, an upper part of the tuning component protrudes from the cover plate, and a lower part of the tuning component runs through the cover plate, to extend into the resonant cavity. The tuning component may include a high-conductivity part and a non-conductivity part.

An embodiment of this application provides a cavity filter having a novel structure, to effectively suppress outward radiation of a signal, greatly increase a Q value of a single cavity, and optimize linearity.

In a first possible implementation of the first aspect, the high-conductivity part may be made of a metal material or may be formed by electroplating an outer surface of a non-metal material. Therefore, the high-conductivity part is formed by using a metal structure or by electroplating.

With reference to the first aspect or the first possible implementation of the first aspect, in a second possible implementation of the first aspect, the high-conductivity part and the non-conductivity part may be fastened through screw thread engagement or injection molding. Structures of the high-conductivity part and the non-conductivity part are not required to be totally the same. For example, the high-conductivity part may be of an axisymmetric structure, and the non-conductivity part may also be of an axisymmetric structure, and may also be in another structure form. It may be understood that the term non-conductivity is relative to the term high-conductivity.

With reference to the first aspect or the first or the second possible implementation of the first aspect, in a third possible implementation of the first aspect, the resonant column is in the cavity, and the resonant column is mounted on a side close to the cover plate. For example, one end of the resonant column is fastened on the cover plate located on a side of the cavity, and the other end of the resonant column is suspended in the cavity. Mounting the resonant column on a cover plate side (that is, on the same side as the tuning component) may allow the electric field to be distributed more evenly in the cavity, thereby improving the linearity and consistency of a frequency change speed of each cavity.

Optionally, the resonant column may further be mounted at the bottom of the cavity. For example, one end of the resonant column is fastened at the bottom of the cavity.

With reference to the third possible implementation of the first aspect, in a fourth possible implementation of the first aspect, the resonant column may be of a hollow structure. When the resonant column is mounted on the side close to the cover plate, the tuning component may be located in the resonant column.

Optionally, a central axis of the tuning component is consistent with a central axis of the resonant column. One end of the tuning component may extend out of the resonant column or may retract in the resonant column. When the resonant column is mounted at the bottom of the cavity, the resonant column may also be of the hollow structure, and the tuning component may extend downward into the resonant column or may be suspended above the resonant column. The resonant column is not connected to the tuning component, and there is a gap between the resonant column and the tuning component. Optionally, the resonant column may also be of a semi-enclosed structure.

According to a second aspect, an embodiment of this application provides a base station. The base station may be the cavity filter included in the foregoing aspect or the implementations of the foregoing aspect.

Embodiments of this application provide a base station including a cavity filter having a novel structure, to effectively suppress outward radiation of a signal, greatly increase a Q value of a single cavity, and optimize linearity.

DESCRIPTION OF EMBODIMENTS

To make objectives, technical solutions, and advantages of this disclosure clearer, the following further describes implementations disclosed in this application in detail with reference to the accompanying drawings.

A person skilled in the art should understand that a cavity filter disclosed in this application is usually of a structure in which resonance is formed by using a cavity structure to achieve a filtering function. Usually, a cavity can be equivalent to a resonate level formed by an inductor in parallel to a capacitor. In a practical scenario, one or more resonant single cavities may usually be formed in the cavity through separating. Different functions of energy coupling are implemented between adjacent resonant single cavities by using different coupling structures. The cavity filter may be usually classified into a coaxial cavity filter, a waveguide cavity filter, a dielectric cavity filter, and the like.

Figure 1:
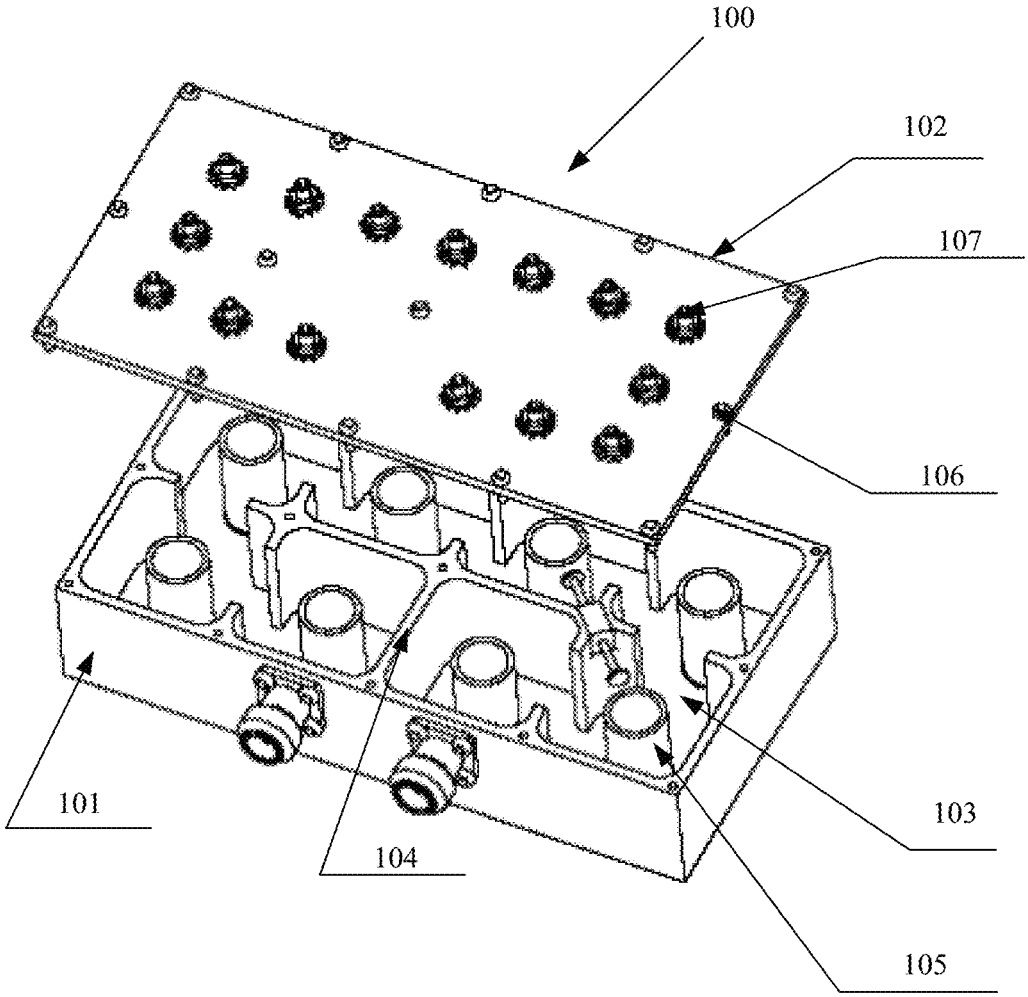
FIG. 1 is a schematic structural diagram of a filter.

Referring to FIG. 1, FIG. 1 is a schematic structural diagram of a filter 100. As shown in FIG. 1, the filter 100 includes: a cavity 101, a cover plate 102, a support piece 104, a resonant element 105, a fastening screw 106, a tuning screw rod 107, and the like. The cavity 101 has one or more resonant single cavities 103. The cavity 101 may form an integrated device in a machining or die-casting manner. The cover plate 102 is formed through die-casting or through machining by using a molding plate. During assembly, the support piece 104 is first assembled to a component and fastened in the cavity 101, the resonant element 105 is fastened in the middle of one of the resonant single cavities 103 of the cavity 101, to form a resonant unit, and then the tuning screw rod 107 is fastened on the cover plate 102. Finally, an assembled cover plate component and an assembled cavity component are assembled together by using the fastening screw 106.

The filter of the existing structure generally has a poor tuning capability and poor linearity. In particular, as the tuning screw rod continuously extends into the resonant cavity, a linear slope of the cavity filter increases excessively fast, thereby affecting performance of the cavity filter.

In view of this, embodiments of this application provide a cavity filtering apparatus having a novel structure. The cavity filtering apparatus may resolve a problem of deterioration of a Q value of a conventional cavity filter. The filtering apparatus provided in the embodiments of this application may be applied to a plurality of communications systems, for example, a 2G communications system such as a global system for mobile communications (GSM) or a general packet radio service (GPRS) system, a 3G communications system such as a code division multiple access (CDMA) system, a time division multiple access (TDMA) system, or a wideband code division multiple access (WCDMA) system, a long term evolution (LTE) system, a microwave backhaul system, and a 5G communications system.

Figure 3:
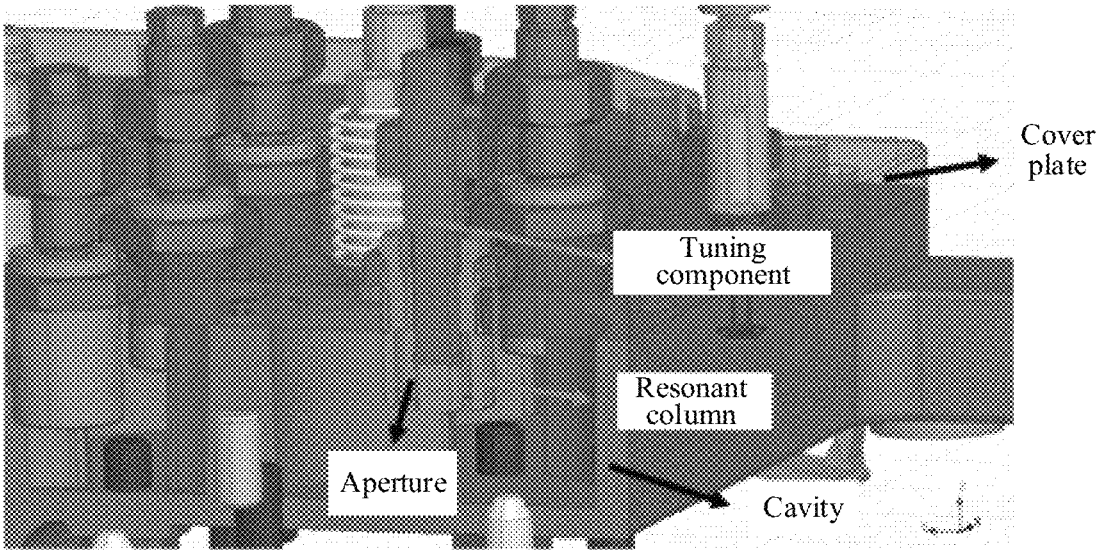
FIG. 3 is a schematic structural diagram of a filter according to an embodiment of this application.

The filtering apparatus disclosed in the embodiments of this application is usually placed in a manner shown in FIG. 1 or FIG. 3. In descriptions of this application, a direction or location relationship indicated by a term "middle," "above," "under," "front," "back," "left," "right," "vertical," "horizontal," "top," "bottom," "inner," "outer," or the like is a direction or location relationship shown based on the accompanying drawings, and is merely intended to describe this application and simplify the descriptions, but is not intended to indicate or imply that a mentioned apparatus or element shall have a specific direction or be formed and operated in a specific direction, and therefore shall not be understood as a limitation on this application. In the descriptions of this application, it should be noted that, unless explicitly specified or limited otherwise, terms "mounting," "connected," and "connection" shall be understood in a general manner. For example, the connection may be a fixed connection, may be a detachable connection, or may further be an abutting connection or an integrated connection. A person of ordinary skill in the art may understand specific meanings of the terms in this application based on specific situations.

In addition, "a plurality of" indicates two or more. The term "and/or" describes an association relationship for describing associated objects and represents that three relationships may exist. For example, A and/or B may represent the following three cases: Only A exists, both A and B exist, and only B exists. The character "/" generally indicates an "or" relationship between the associated objects.

Figure 2:
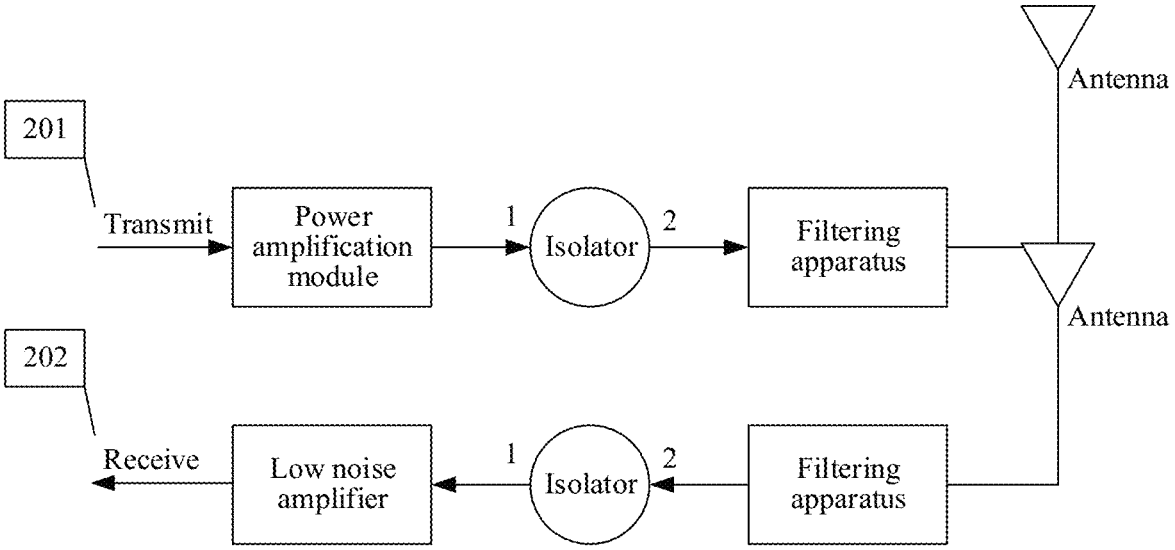
FIG. 2 is a schematic diagram of an application scenario or a system architecture according to an embodiment of this application.

The apparatus disclosed in the embodiments of this application may be applied to a microwave outdoor unit link system. As shown in FIG. 2, an embodiment of this application may be applied to a transmit link channel 201 or a receive link channel 202 of a frequency division system. When this embodiment of this application is applied to a transmit link and a transmit signal passes through a filter, a signal that is not required by the system is filtered out, to ensure that a wanted signal passes through the filter and arrives at an antenna for radiation. When this embodiment of this application is applied to a receive link, a receive signal enters a filter from an antenna end, and the filter filters out an external interference signal, to ensure that a wanted signal passes through the filter and arrives at a back-end device. The apparatus disclosed in the embodiments of this application may be applied to a microwave frequency band, or may be applied to a frequency band less than 3 GHz.

The filtering apparatus provided in the embodiments of this application may be applied to a plurality of communications devices that need to select a signal frequency. For example, the filtering apparatus may be used in a base station device.

FIG. 3 is a schematic structural diagram of a filtering apparatus 300 according to an embodiment of this application. The filtering apparatus 300 mainly includes a cavity, a cover plate, a tuning component, and a resonant column. The following provides detailed descriptions with reference to a schematic structural diagram shown in FIG. 4.

Figure 4:
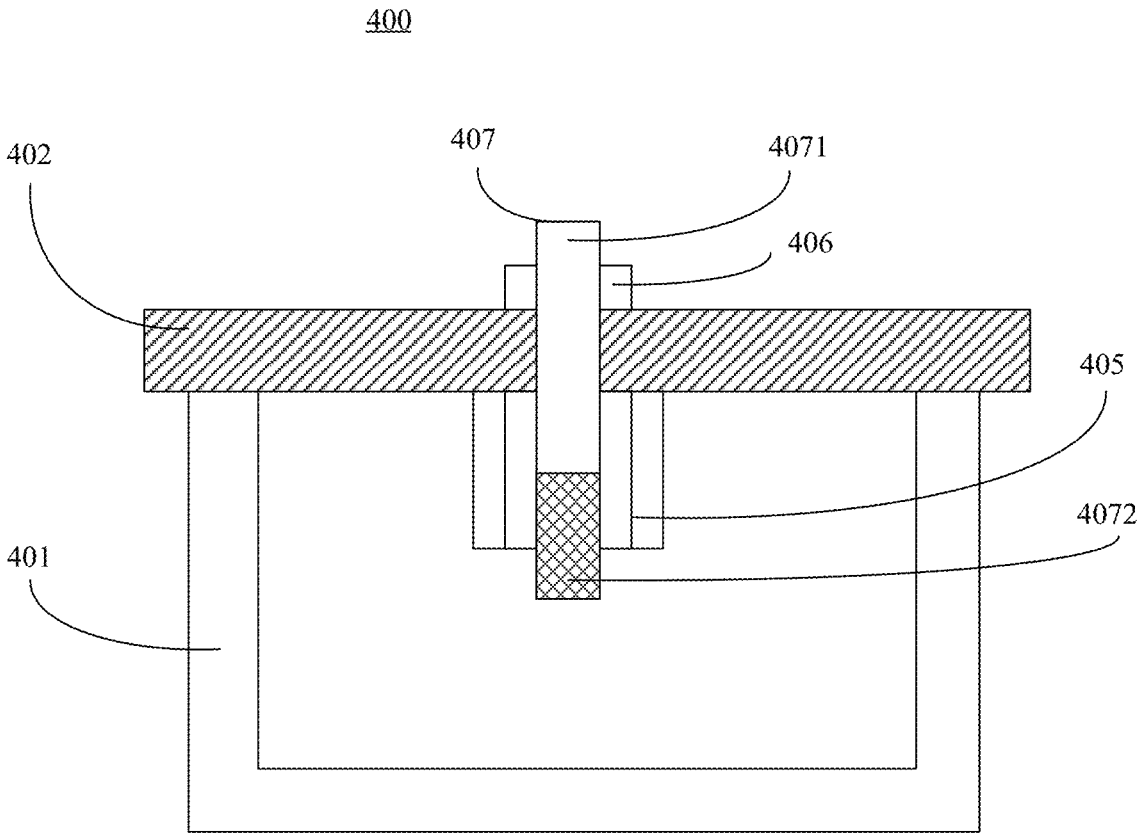
FIG. 4 is a partial schematic structural diagram of a filter according to an embodiment of this application.

FIG. 4 is a schematic front view of a partial structure of a filtering apparatus 400 according to an embodiment of this application. A resonant cavity is used as an example herein for description. In a specific application scenario, the resonant cavity may include a plurality of resonant single cavities. It can be learned from FIG. 4 that the filtering apparatus 400 may include a cavity 401, a cover plate 402, a tuning component 407, a resonant column 405, a fastening apparatus 406, and the like. The tuning component 407 may include at least two parts: a high-conductivity part 4072 and a non-conductivity part 4071. It should be noted that the term non-conductivity is relative to the term high-conductivity. The cover plate 402 covers the cavity 401 to form a resonant cavity. A through hole is provided on the cover plate 402, the tuning component 407 passes through the through hole and is fastened on the cover plate 402, so that one end (the non-conductivity part 4071) of the tuning component 407 is located above the cover plate 402, and the other end (the high-conductivity part 4072) of the tuning component 407 is located under the cover plate 402. The tuning component 407 may be fastened by using the fastening apparatus 406. The fastening apparatus 406 may be fastened by using a threaded structure. It may be understood that the fastening apparatus 406 is adjustable. By using the fastening apparatus 406, the tuning component 407 may move in a direction parallel to an electric field of the cavity. As shown in FIG. 4, the tuning component 407 may move up and down by using the through hole, to implement specific tuning performance.

Optionally, the non-conductivity part 4071 may be connected to a motor system, so that the high-conductivity part 4072 may move in the cavity, thereby adjusting resonance and implementing excellent frequency shift performance of a tunable filtering apparatus. The resonant column 405 is located on a side that is of resonant cavity and that is close to the cover plate 402. One end of the resonant column 405 is fastened on the cover plate, and the other end extends into the cavity.

The resonant column 405 may be of a hollow structure, and a part of the tuning component 407 located in the resonant cavity is located in the resonant column 405. Optionally, a central axis of the tuning component 407 is consistent with a central axis of the resonant column 405. The resonant column 405 may be of an axisymmetric structure, and is typically, for example, a hollow cylinder, or may be of a semi-enclosed structure.

As described above, the tuning component 407 includes at least two parts: the high-conductivity part 4072 and the non-conductivity part 4071. The high-conductivity part 4072 may be made of a metal material, or may be formed by electroplating an outer surface of a non-metal material. The high-conductivity part 4072 is located in the resonant cavity, or may be located in the resonant column 405. One end of the high-conductivity part 4072 extending downward into the cavity may be located in the resonant column 405, or may protrude from a lower outer edge of the resonant column 405. Details are shown in FIG. 4.

Although the tuning component 407 includes the at least two parts, all of the parts may be understood as a whole, and the high-conductivity part 4072 and the non-conductivity part 4071 may be fastened through screw thread engagement or injection molding (e.g. injection molded bosses). A specific fastening manner may be determined based on a requirement of an application scenario. A ratio of a length of the high-conductivity part 4072 to a length of the non-conductivity part 4071 included in the tuning component 407 disclosed in this application is not limited, and may be determined based on a requirement of a specific application scenario. The high-conductivity part 4072 may be of an axisymmetric structure.

Figure 7:
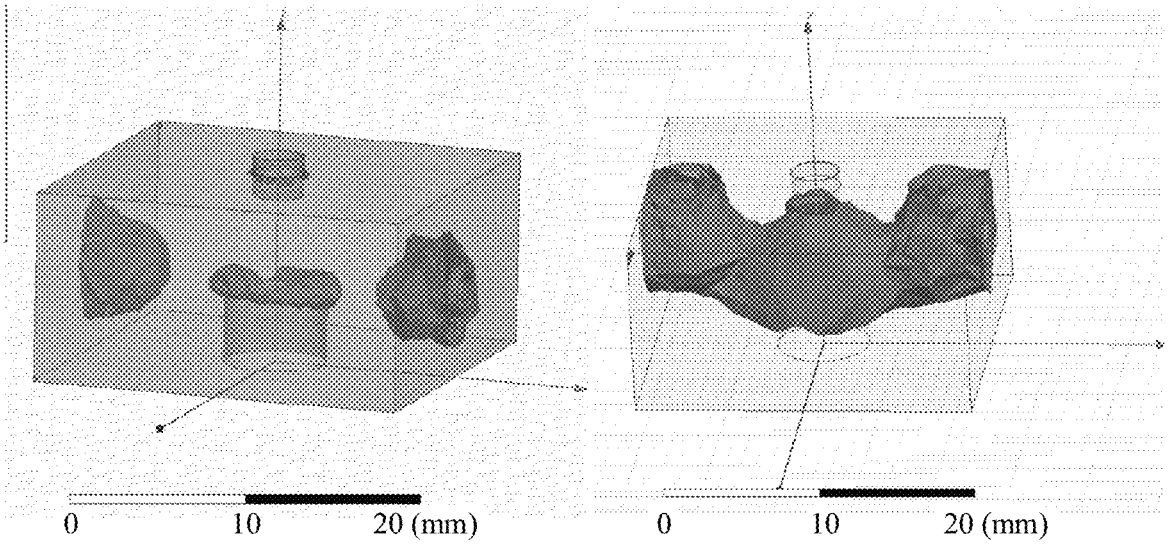
FIG. 7 is a schematic diagram of performance comparison of a filter for implementing tunable filtering according to an embodiment of this application.

In view of this, the filtering apparatus 400 provided in the embodiments of this application may effectively suppress outward radiation of a signal, greatly increase a Q value of a single cavity, and optimize linearity. A signal is shielded at a division interface of the cover plate by using a non-conductivity material, so that energy storage in the cavity is stable, and outward radiation of the signal by using the tuning component is prevented. Through experimental simulation, a Q value of a single cavity of the cavity filter 400 provided in the embodiments of this application may be increased by 1200, and a single-channel system gain may be increased by 0.5 dB. Mounting the resonant column 405 on a cover plate side (that is, on the same side as the tuning component 407) may allow the electric field to be distributed more evenly in the cavity, thereby improving the linearity and consistency of a frequency change speed of each cavity. Details are shown in FIG. 7.

Figure 5:
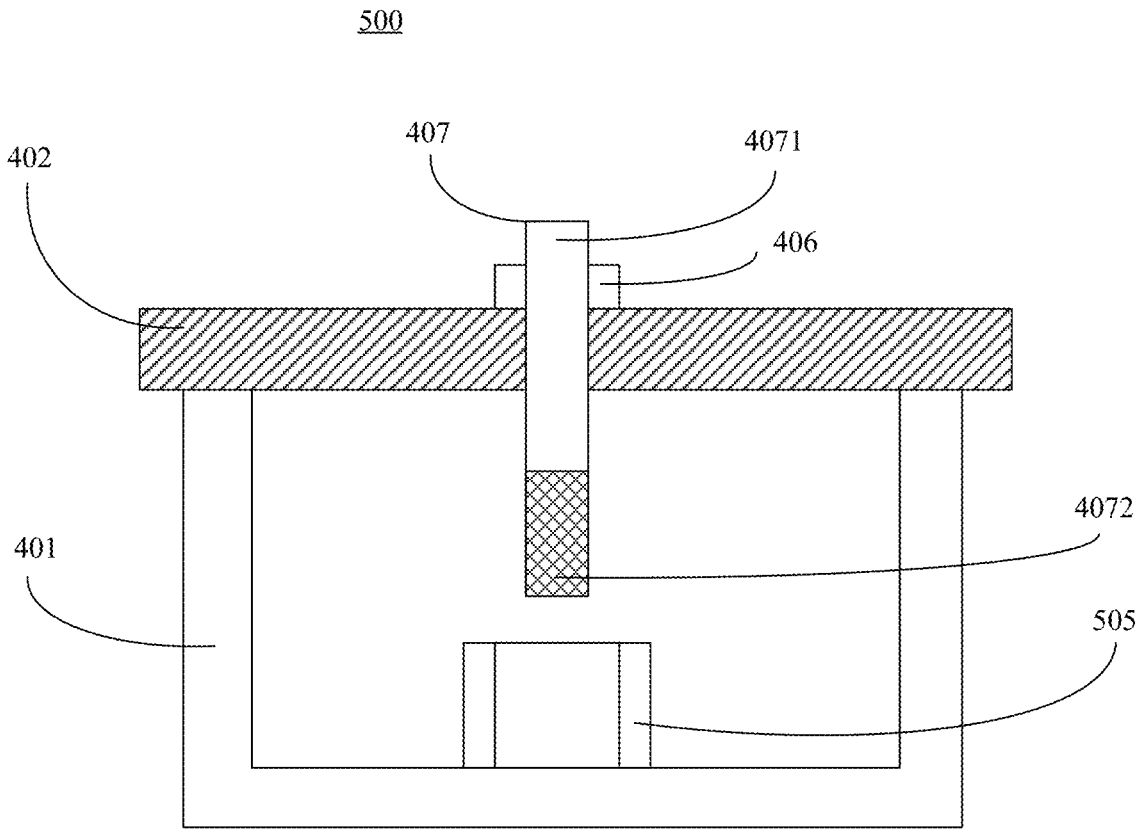
FIG. 5 is a partial schematic structural diagram of another filter according to an embodiment of this application.
Figure 6:
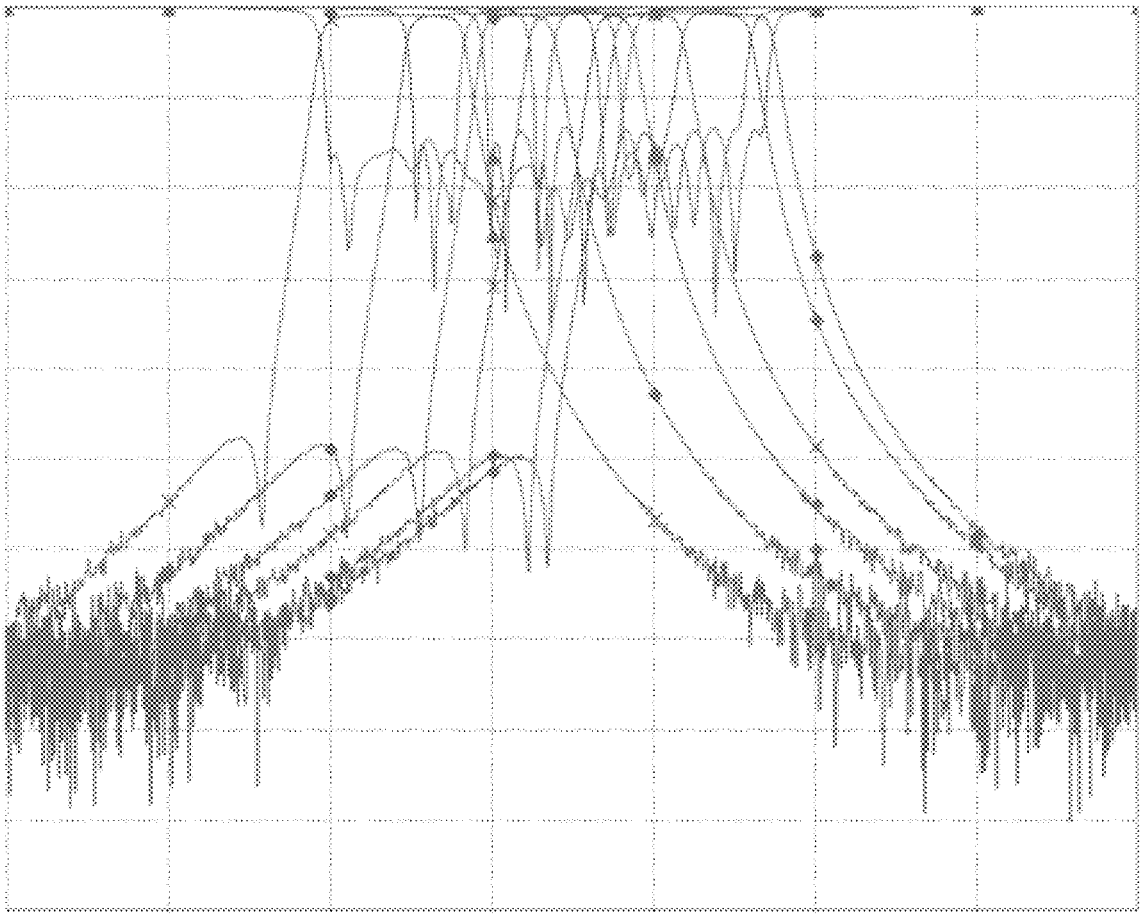
FIG. 6 is a schematic diagram of frequency shift performance of a filter for implementing tunable filtering according to an embodiment of this application.

FIG. 5 is a schematic front view of a partial structure of another filtering apparatus 500 according to an embodiment of this application. Different from the filtering apparatus 400 shown in FIG. 4, a resonant column 505 is located at the bottom of a cavity, one end of the resonant column 505 is fastened at the bottom of a cavity 401, and a high-conductivity part 4072 of a resonant unit 407 may extend into the resonant column 505, or may be located above the resonant column 505, as shown in FIG. 5. A location of the high-conductivity part 4072 of the resonant unit 407 may be determined based on a requirement of an application scenario.

In view of this, the embodiments of this application provide a filtering apparatus 500. The filtering apparatus may suppress outward radiation of a signal, greatly increase a Q value of a single cavity, and optimize linearity. A signal is shielded at a division interface of the cover plate by using a non-conductivity material, so that energy storage in the cavity is stable, and outward radiation of the signal by using the tuning component is prevented. Through experimental simulation, a Q value of a single cavity of the cavity filter 500 provided in the embodiments of this application may be increased by 1200, and a single-channel system gain may be increased by 0.5 dB.

It may be understood that the foregoing filtering apparatus provided in the embodiments of this application may be applied to the field of mobile communications technologies, or may be applied to another field with a corresponding requirement. For example, the filtering apparatus is applied to a base station, when receiving a user signal, the base station needs to control, by using the filtering apparatus, an interference signal outside a communications channel to a specific level, and when the base station is in contact with a user, a signal (usually with high power) sent by the base station to the user may further passes through the filtering apparatus, and then an interference signal that is outside the channel and that is generated by a transmitter is controlled to an allowed level, thereby preventing interference performed on adjacent channels and ensuring normal communication. In addition, when the filtering apparatus forms a duplexer, the filtering apparatus may be further configured to isolate a signal of a receive channel from a signal of a transmit channel, to reduce interference performed on each other.

The foregoing descriptions are merely specific implementations of this application, but are not intended to limit the protection scope of this application. Any variation or replacement readily figured out by a person skilled in the art within the technical scope disclosed in this application shall fall within the protection scope of this application. Therefore, the protection scope of this application shall be subject to the protection scope of the claims.

What is claimed is:

1. A cavity filtering apparatus, comprising a cavity, a cover plate, a tuning component, and a resonant column, wherein the cover plate is connected to the cavity, the cover plate is configured to cover the cavity to form a resonant cavity, a through hole is provided on the cover plate, the tuning component passes through the through hole and is fastened on the cover plate, the tuning component comprises a high-conductivity part and a non-conductivity part, the high-conductivity part is located in the cavity, and the resonant column is in the cavity, and wherein the high-conductivity part of the tuning component is located under the cover plate only.

2. The cavity filtering apparatus according to claim 1, wherein the high-conductivity part is made of a metal material.

3. The cavity filtering apparatus according to claim 1, wherein the high-conductivity part is formed by electroplating an outer surface of a non-metal material.

4. The cavity filtering apparatus according to claim 1, wherein the high-conductivity part and the non-conductivity part are fastened through screw thread engagement.

5. The cavity filtering apparatus according to claim 1, wherein the high-conductivity part and the non-conductivity part are fastened through injection molding.

6. The cavity filtering apparatus according to claim 1, wherein the high-conductivity part is of an axisymmetric structure.

7. The cavity filtering apparatus according to claim 1, wherein the resonant column is mounted on the cover plate, and the resonant column comprises: one end of the resonant column is fastened on the cover plate located on a side of the cavity, and the other end of the resonant column is suspended in the cavity.

8. The cavity filtering apparatus according to claim 7, wherein the resonant column is of a hollow structure, the tuning component is located in the resonant column, and the tuning component and the resonant column share a common central axis.

9. The cavity filtering apparatus according to claim 7, wherein the resonant column is a hollow cylinder.

10. The cavity filtering apparatus according to claim 7, wherein the resonant column is of a semi-enclosed structure.

11. The cavity filtering apparatus according to claim 1, wherein the resonant column is mounted on the cavity, and the resonant column comprises: one end of the resonant column is fastened at a bottom of the cavity opposite from the cover plate, and the other end of the resonant column is in the cavity.

12. The cavity filtering apparatus according to claim 11, wherein the resonant column is of a hollow structure, the tuning component is inserted in the resonant column, and the tuning component and the resonant column share a common central axis.

13. The cavity filtering apparatus according to claim 11, wherein the resonant column is a hollow cylinder.

14. The cavity filtering apparatus according to claim 11, wherein the resonant column is of a semi-enclosed structure.

15. A base station, comprising the cavity filtering apparatus according to claim 1.

* * * * *